US005893706A

United States Patent [19]

Kawaguchi et al.

[11] Patent Number: 5,893,706

[45] Date of Patent: Apr. 13, 1999

[54] COOLING STRUCTURE FOR COMPRESSOR

[75] Inventors: Masahiro Kawaguchi; Masanori Sonobe; Takuya Okuno, all of Kariya; Takashi Michiyuki, Anjo; Ken Suitou; Shinichi Ogura, both of Kariya, all of Japan

[73] Assignee: Kabushiki Kaisha Toyoda Jidoshokki Seisakusho, Kariya, Japan

[21] Appl. No.: 08/626,398

[22] Filed: Apr. 2, 1996

[30] Foreign Application Priority Data

Apr. 7, 1995 [JP] Japan ..... 7-082740
Oct. 18, 1995 [JP] Japan ..... 7-270285

[51] Int. Cl.[6] ..... F04B 17/00; F04B 1/12

[52] U.S. Cl. ..... 417/373; 417/269; 417/362; 416/60; 184/6.17; 184/6.22; 184/104.1

[58] Field of Search ..... 417/269, 271, 417/362, 372, 423.8, 373; 418/101; 62/470; 416/60; 184/6.17, 6.22, 104.1

[56] References Cited

U.S. PATENT DOCUMENTS

| | | | |
|---|---|---|---|
| 1,812,060 | 6/1931 | Rayfield | 416/60 |
| 2,876,948 | 3/1959 | Hockel et al. . | |
| 3,458,114 | 7/1969 | Catterson . | |
| 4,129,405 | 12/1978 | McCullough | 418/101 |
| 5,173,032 | 12/1992 | Taguchi et al. | 417/222.2 |
| 5,417,554 | 5/1995 | Kietzman et al. | 418/101 |
| 5,528,976 | 6/1996 | Ikeda et al. | 417/269 |
| 5,586,870 | 12/1996 | Kawaguchi et al. | 417/269 |
| 5,636,974 | 6/1997 | Ikeda et al. | 417/269 |

FOREIGN PATENT DOCUMENTS

| | | |
|---|---|---|
| 976927 | 3/1951 | France . |
| 1360938 | 8/1964 | France . |
| 50-86312 | 7/1975 | Japan . |
| 57-68185 | 4/1982 | Japan . |
| 58-56187 | 4/1983 | Japan . |
| 6346845 | 12/1994 | Japan . |

*Primary Examiner*—Charles G. Freay
*Attorney, Agent, or Firm*—Brooks Haidt Haffner & Delahunty

[57] ABSTRACT

A compressor having a compression mechanism within a housing for compressing a refrigerant gas according to the rotation of a rotary shaft operatively connected to an external power source. A pulley is mounted on the rotary shaft and located on one side of the housing for transmitting power from the external power source to the shaft. A fan sends air to the outer surface of the housing by rotating with the pulley. Heat transferring fins are provided on the housing adjacent to the fan.

14 Claims, 11 Drawing Sheets

COOLING STRUCTURE FOR COMPRESSOR

BACKGROUND OF THE INVENTION

1. Field of the Invention

The present invention relates to compressors, and more particularly, to compressors that have a cooling structure.

2. Description of the Related Art

Typically, compressors are mounted in vehicles to air-condition the passenger compartments. It is preferable to employ a compressor, the displacement of which is adjustable, to accurately control the temperature in the interior of the vehicle to maintain an environment comfortable to the passengers. A typical compressor has a swash plate, which is mounted tiltably on a rotary shaft. The inclination of the swash plate is controlled by the difference between the pressure in a crank chamber and the suction pressure. The rotation of the swash plate is converted to a reciprocal linear movement of pistons.

Lubricating oil, which lubricates the inside of the compressor, is mixed with the refrigerant gas and flows together with it. The interior of the compressor is sealed by a rubber seal. To cope with deterioration of the lubricating oil and the seal, which is caused by heat produced in the compressor, various measures have been taken in the prior art. One of these measures is described in Japanese Unexamined Utility Model Publication 50-86312. Heat transferring fins are provided on the outer surface of the compressor of this publication.

The 50-86312 publication describes a compressor that transmits the drive force of a vehicle's engine to a rotary shaft through an electromagnetic clutch. Longitudinally extending fins are provided on the outer periphery of the compressor housing. A fan, which sends ambient air to the fins, is mounted on a pulley. Since a solenoid, used for a clutch, is located between the pulley and the compressor housing, the fan is arranged around the periphery of the pulley. The outer diameter of the pulley is about the same as the outer diameter of the housing. Therefore, it is required that the fins project a long distance in the radial direction of the compressor to efficiently cool the fins with the fan. However, such structure enlarges the compressor thus using valuable engine compartment space.

SUMMARY OF THE INVENTION

It is an objective of the present invention to provide a compressor having an enhanced heat releasing capability without increasing its size.

To achieve the above objective, a compressor has a compression mechanism within a housing for compression of refrigerant gas according to the rotation of a rotary shaft operatively connected to an external power source. The compressor includes a rotary member, a fan, and a heat transferring fin. The rotary member is mounted on the rotary shaft and located on one side of the housing for transmitting power from the external power source to the rotary shaft. The fan sends air to the outer surface of the housing by rotating with the rotary member. The heat transferring fin is provided on the housing and located adjacent to the fan.

BRIEF DESCRIPTION OF THE DRAWINGS

The features of the present invention that are believed to be novel are set forth with particularity in the appended claims. The invention, together with objects and advantages thereof, may best be understood by reference to the following description of the presently preferred embodiments together with the accompanying drawings in which:

DETAILED DESCRIPTION OF THE PREFERRED EMBODIMENTS

A first embodiment of a compressor according to the present invention will now be described with reference to FIGS. 1 to 5.

Figure 1:
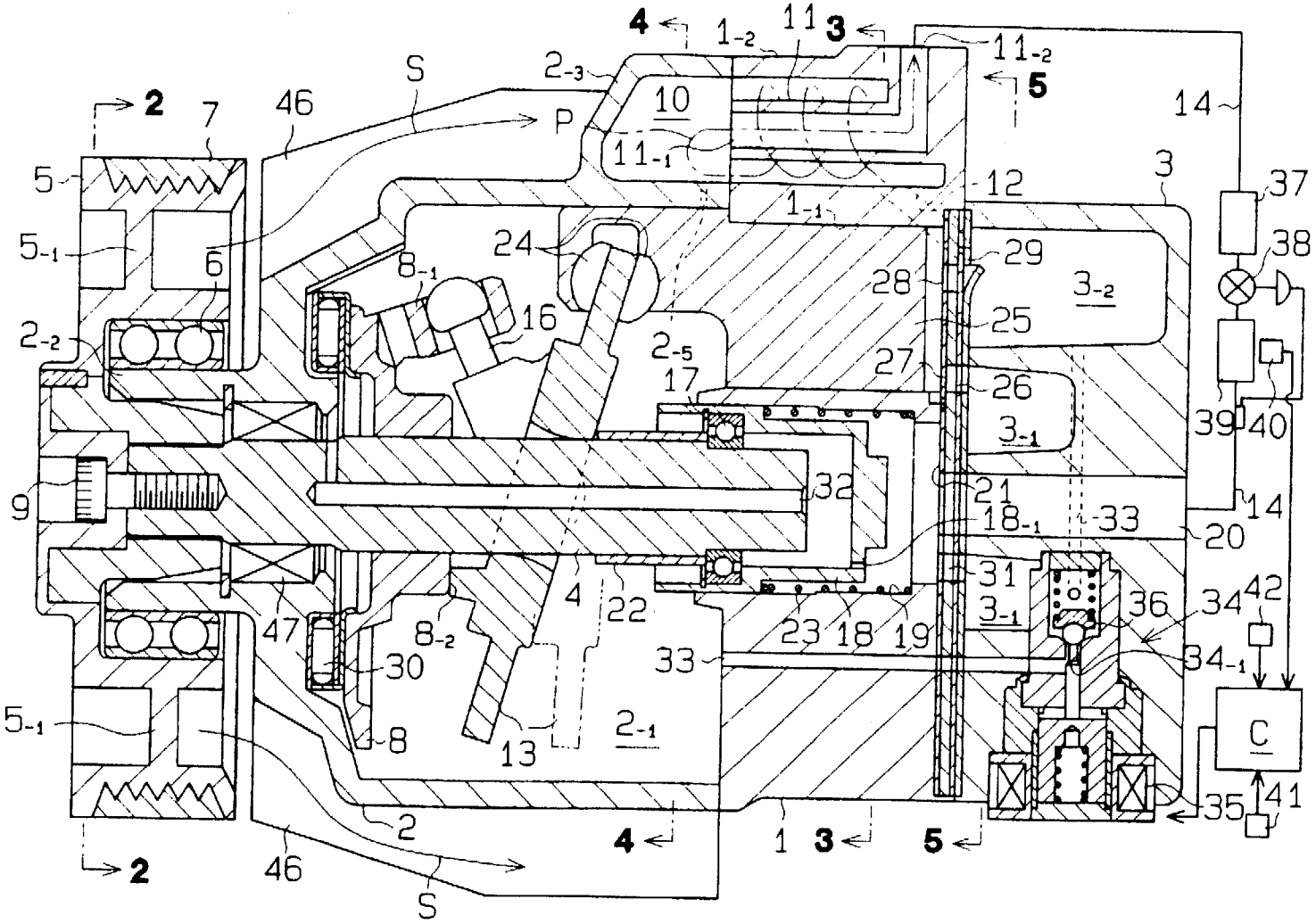
FIG. 1 is a side cross-sectional view showing a compressor according to a first embodiment of the present invention.

As shown in FIG. 1, a front housing 2 is coupled to the front end of a cylinder block 1 and a rear housing 3 is coupled to the rear end of the block 1. The cylinder block 1, front housing 2, and rear housing 3 constitute a compressor housing. A crank chamber $2_{-1}$ is defined inside the front housing 2 and the block 1. A rotary shaft 4 is rotatably supported in the front housing 2 and block 1 with its front end protruding externally from the crank chamber $2_{-1}$. A rubber lip seal 47 is located between the front section of the shaft 4 and the front housing 2. The lip seal 47 prevents the escape of pressure from the crank chamber $2_{-1}$.

Figure 2:
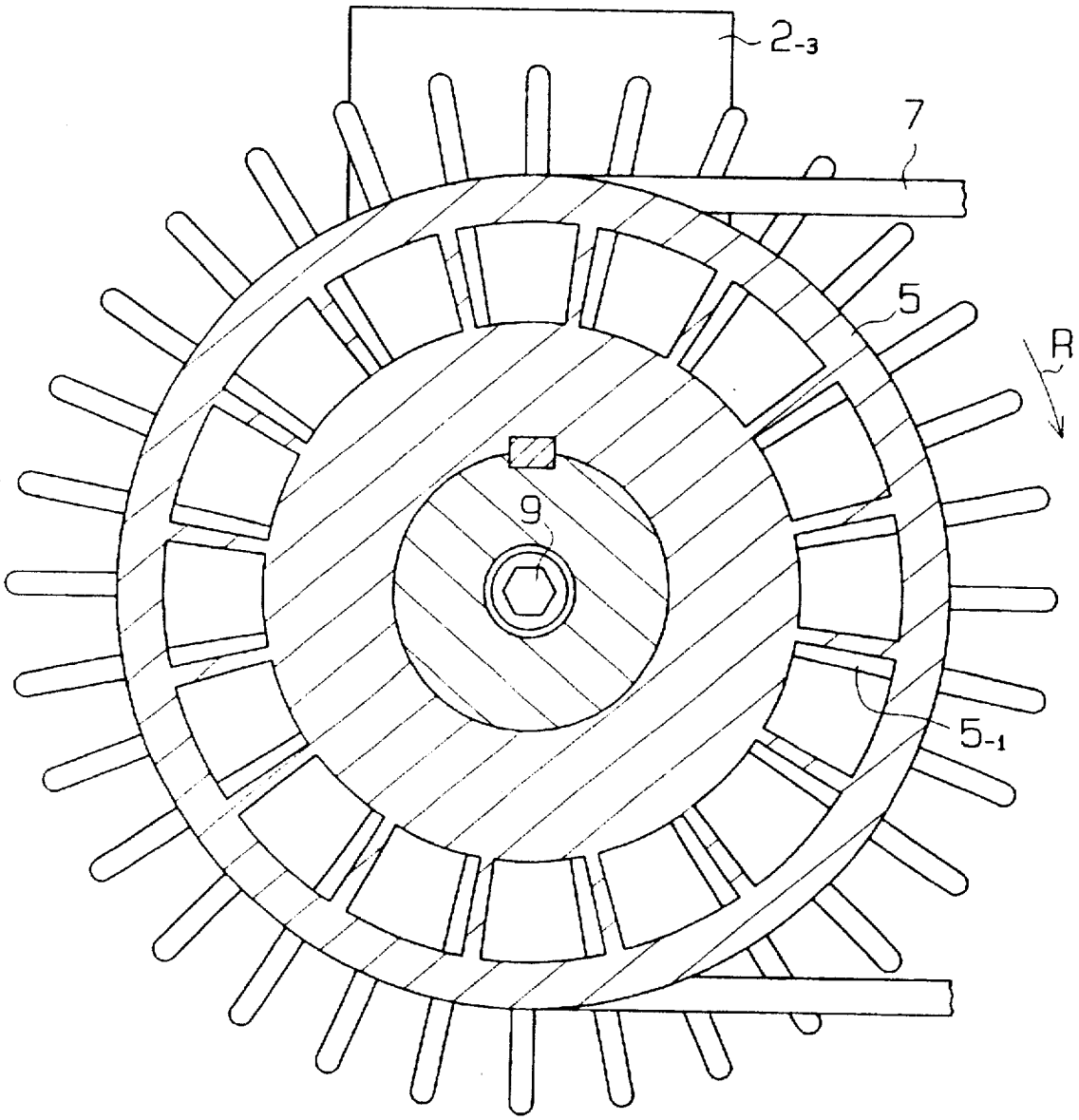
FIG. 2 is a cross-sectional view along line 2—2 of FIG. 1.

A hollow boss $2_{-2}$ is formed integrally on the front housing 2. A rotating member, or pulley 5, is rotatably supported by an angular contact bearing 6 on the boss $2_{-2}$. The bearing 6 carries the load in both axial and radial directions. The pulley 5 is connected to an engine (not shown), serving as an external drive source, by a belt 7. In this structure, a clutch mechanism is not employed to connect the pulley 5 with the engine. The front end of the shaft 4 is coupled to the pulley 5 by a bolt 9. As shown in FIG. 2, a fan $5_{-1}$ is provided integrally with the pulley 5. The fan $5_{-1}$ is formed inside the periphery of the pulley 5 and thus has an outer diameter smaller than the pulley 5. The outer diameter of the pulley 5 is approximately equal to the outer diameter of the front housing 2. The pulley 5 rotates in a direction indicated by arrow R, as shown in FIG. 2, and the fan $5_{-1}$ sends ambient air in a direction indicated by arrow S, as shown in FIG. 1.

Figure 4:
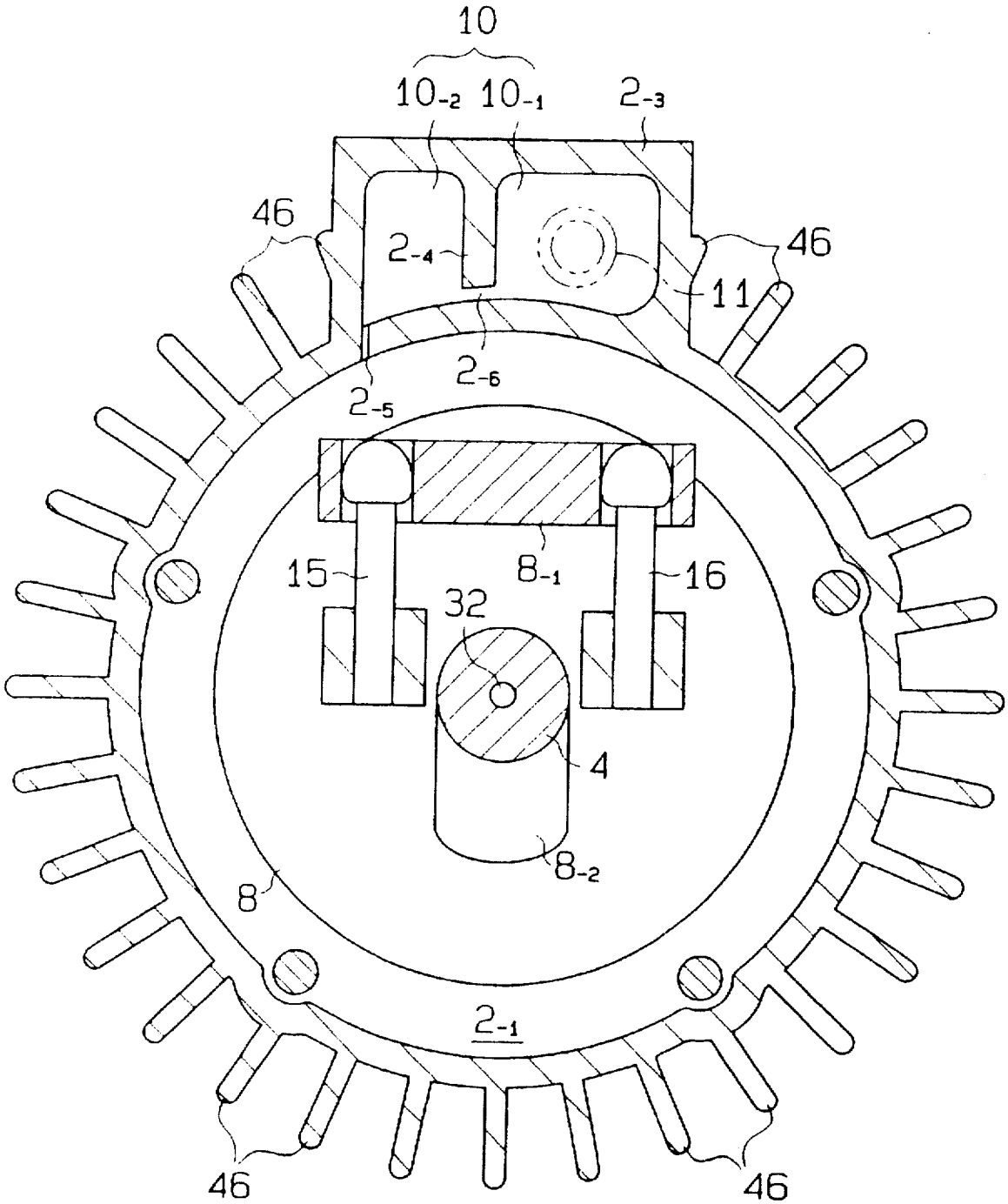
FIG. 4 is a cross-sectional view along line 4—4 of FIG. 1.

A drive plate 8 is secured to the shaft 4. A swash plate 13 is mounted on the shaft 4 and is supported in a manner such that it slides and tilts in the axial direction of the shaft 4. As shown in FIG. 4, the connection between the support arm $8_{-1}$ of the drive plate 8 and a pair of guide rods 15, 16 enables the tilting of the swash plate 13. The tilting of the swash plate 13 is guided by the support arm $8_{-1}$, the rods 15, 16 and the shaft 4.

The block 1 has a retaining hole 19. The rear end of the shaft 4 is supported in the inner peripheral surface of the hole 19 by a bearing 17 and a cup-shaped spool 18. The bearing 17 carries the load in both radial and axial directions. A suction passage 20 is defined in the center of the rear housing 3. The suction passage 20 communicates with the retaining hole 19. A positioning surface 21 is defined about the outlet of the suction passage 20. The distal end of the spool 18 abuts against the positioning surface 21. As the spool 18 moves away from the swash plate 13, abutment of the distal end of the spool 18 against the positioning surface 21 restricts the movement of the spool 18 and disconnects the suction passage 20 from the retaining hole 19.

As the swash plate 13 tilts toward the spool 18, the swash plate 13 abuts against a bushing 22 and pushes the bushing 22 and the bearing 17 toward the positioning surface 21. This moves the spool 18 against the urging force of a spring 23, arranged inside the retaining hole 19, until its distal end abuts against the positioning surface 21.

As shown by the chain line of FIG. 1, the minimum inclined position of the swash plate 13 is almost but not exactly perpendicular to the shaft 4. The minimum inclined position of the swash plate 13 is obtained when the spool 18 is moved to a closing position where the spool 18 disconnects the suction passage 20 from the retaining hole 19. The maximum inclined position of the swash plate 13 is restricted by the abutment of the swash plate 13 against a restricting projection $8_{-2}$ provided on the drive plate 8. The rotation of the swash plate 13 is converted to reciprocal linear movement of a single-headed piston 25, which is accommodated in each cylinder bore $1_{-1}$, through shoes 24.

Figure 5:
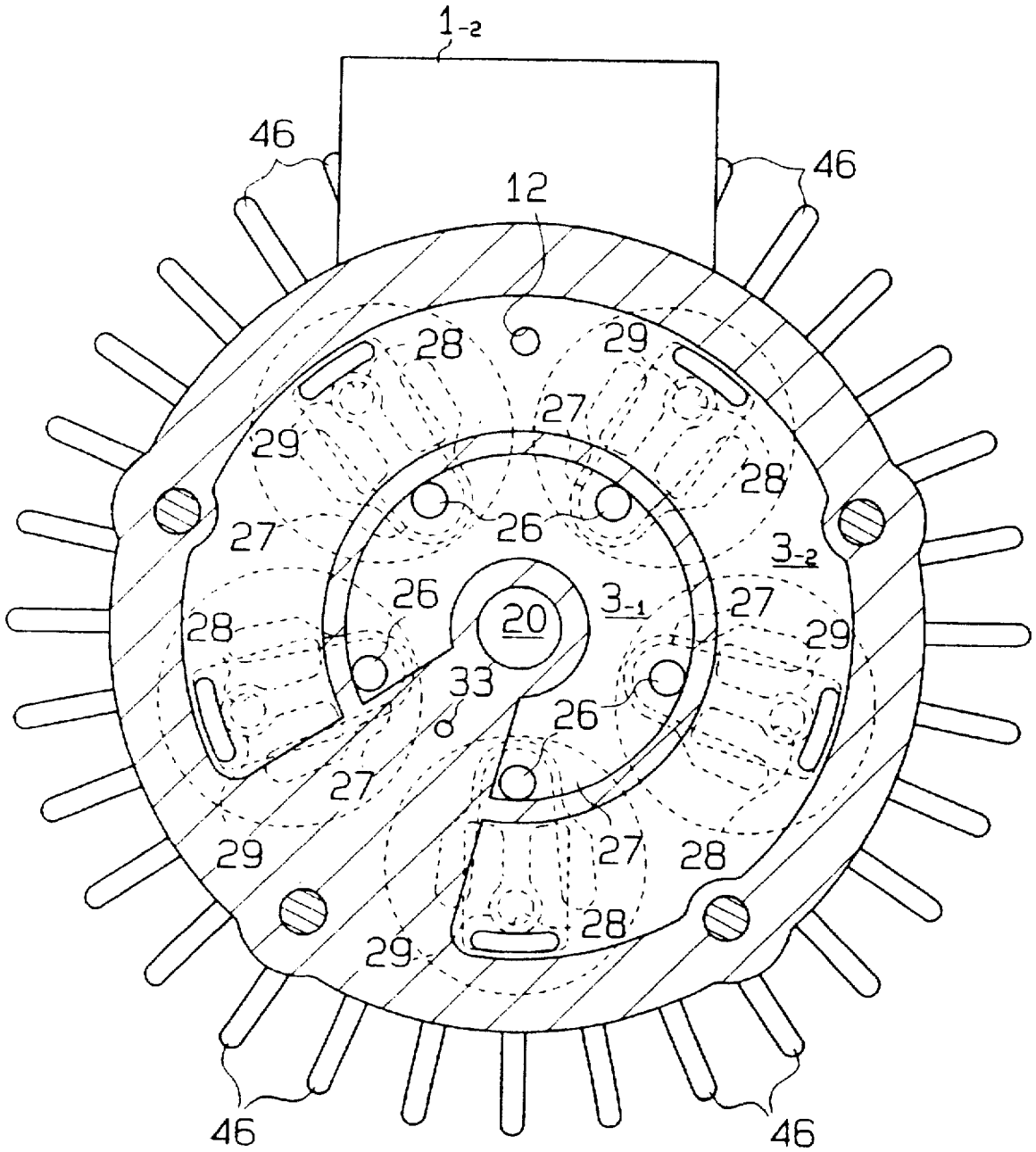
FIG. 5 is a cross-sectional view along line 5—5 of FIG. 1.

As shown in FIGS. 1 and 5, a suction chamber $3_{-1}$ and a discharge chamber $3_{-2}$ are defined inside the rear housing 3. Refrigerant gas in the suction chamber $3_{-1}$ is drawn into each cylinder bore $1_{-1}$ via suction ports 26 and suction valves 27 when the associated piston 25 moves away from the suction chamber $3_{-1}$. After the gas is compressed in the cylinder bore $1_{-1}$ when the piston 25 moves in a reversed direction, the gas flows through a discharge port 28 and a discharge valve 29 and is discharged into the discharge chamber $3_{-2}$. The suction chamber $3_{-1}$ is connected to the retaining hole 19 through a passageway 31. When the spool 18 is moved to the closing position, the passageway 31 is disconnected from the suction passage 20.

A thrust bearing 30 is located between the drive plate 8 and the front housing 2. The bearing 30 carries the reaction force, which is produced during compression of the gas inside the bores $1_{-1}$ and applied to the drive plate 8 by way of the pistons 25, shoes 24, swash plate 13, and guide pins 15, 16.

A conduit 32 is provided in the shaft 4. The conduit 32 connects the crank chamber $2_{-1}$ with the interior of the spool 18. A pressure releasing hole $18_{-1}$ is provided at the distal end of the spool 18. The hole $18_{-1}$ connects the interior of the spool 18 with the interior of the retaining hole 19.

As shown in FIG. 1, the crank chamber $2_{-1}$ and the suction chamber $3_{-1}$ are connected to each other by a pressurizing passage 33. An electromagnetic valve 34 is provided in the pressurizing passage 33 to open or close the passage 33. Activation of a solenoid 35 in the electromagnetic valve 34 results in a valve body 36 closing the valve hole $34_{-1}$. Deactivation of the solenoid 35 results in the body 36 opening the hole $34_{-1}$.

A muffler chamber 10 extends along the peripheral surface of the block 1 and the front housing 2. The muffler chamber 10 is defined by a wall $1_{-2}$, formed integrally with the block 1, and a wall $2_{-3}$, formed integrally with the front housing 2. A cylindrical oil separator 11 is arranged in the muffler chamber 10. The separator 11 is formed integrally with the block 1 and extends parallel to the axis of the shaft 4. The inlet $11_{-1}$ of the separator 11 is faced toward the wall $2_{-3}$ and opens in the muffler chamber 10. The outlet $11_{-2}$ of the separator 11 opens in the surface of the wall $1_{-2}$ and constitutes an outgoing port of the muffler chamber 10.

Figure 3:
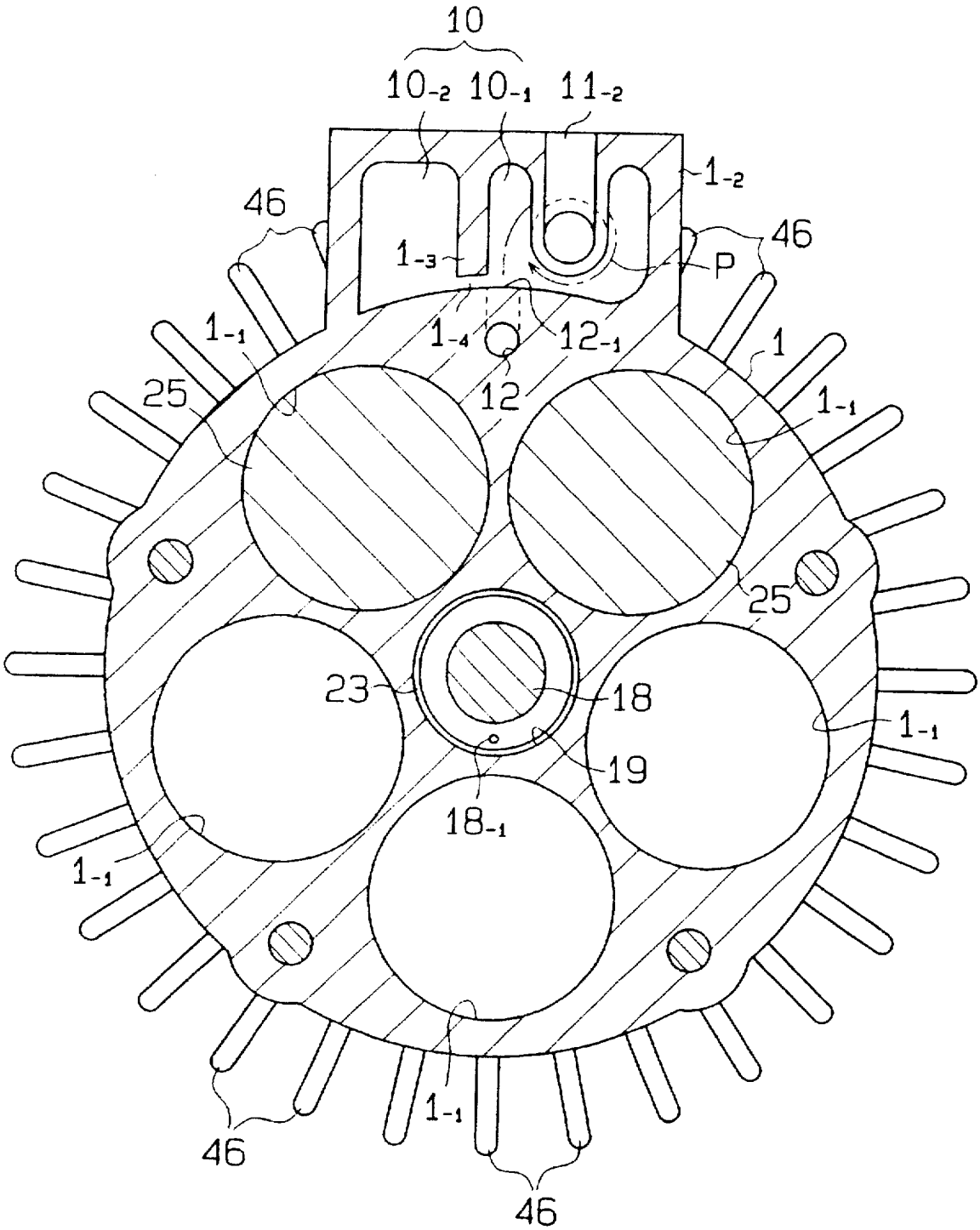
FIG. 3 is a cross-sectional view along line 3—3 of FIG. 1.

As shown in FIGS. 3 and 4, a gas circulation compartment $10_{-1}$ and an oil reserve compartment $10_{-2}$ are defined by partitions $1_{-3}$, $2_{-4}$ inside the muffler chamber 10. The compartments $10_{-1}$, $10_{-2}$ are connected to each other by oil passages $1_{-4}$, $2_{-6}$ defined in the partition $2_{-4}$. The circulation compartment $10_{-1}$ and the discharge chamber $3_{-2}$ are connected by a discharge passage 12, as shown in FIGS. 1 and 3. As shown in FIG. 3, an outlet $12_{-1}$ of the discharge passage 12 is located between the partition $1_{-3}$ and the separator 11. The outlet $12_{-1}$ serves as a port where refrigerant gas enters into the muffler chamber 10. The reserve compartment $10_{-2}$ is connected with the crank chamber $2_{-1}$ through a restricted passage $2_{-5}$.

A plurality of plate-like fins 46 are formed integrally on the outer periphery of the front housing 2. The fins 46 extend from the front end of the front housing 2 to the front end of the block 1 along the axial direction of the shaft 4. As shown in FIGS. 2 and 4, the rear ends of some of the fins 46 are connected to the wall $2_{-3}$ of the muffler chamber 10.

The suction passage 20, which is used to introduce refrigerant gas into the suction chamber $3_{-1}$, and the outlet $11_{-2}$ are connected to each other by an external refrigerant circuit 14. The circuit 14 includes a condenser 37, an expansion valve 38, and an evaporator 39. The expansion valve 38 controls the flow rate of the refrigerant gas in accordance with the change in gas temperature at the outlet side of the evaporator 39. A temperature sensor 40 is provided in the vicinity of the evaporator 39. The sensor 40 detects the temperature of the evaporator 39 and transmits the detected value to a computer C. The computer C controls the solenoid 35 of the electromagnetic valve 34 in accordance with the temperature data from the sensor 40.

When an operation switch 41 of an air-conditioning system is in a state that it is turned on, the computer C commands the deactivation of the solenoid 35 to prevent formation of frost in the evaporator 39 as the temperature falls below a predetermined value. An engine speed sensor 42 is also connected to the computer C. When the switch 41 is in a state that it is turned on, the computer C receives the detected value of the engine speed from the sensor 42. The computer C deactivates the solenoid 35 when the engine speed exceeds a predetermined value.

The computer C also deactivates the solenoid 35 when the switch is turned off. Deactivation of the solenoid 35 opens the pressurizing passage 33 and communicates the discharge chamber $3_{-2}$ with the crank chamber $2_{-1}$. This causes the highly pressurized refrigerant gas in the discharge chamber $3_{-2}$ to flow into the crank chamber $2_{-1}$ and raise the pressure in the crank chamber $2_{-1}$. The pressure increase in the crank chamber $2_{-1}$ reduces the inclination of the swash plate 13. When the distal end of the spool 18 abuts against the positioning surface 21, the inclination of the swash plate 13 is minimum and the flow of refrigerant gas from the refrigerant circuit 14 to the suction chamber $3_{-1}$ is blocked.

Since the minimum inclined position of the swash plate 13 is not perpendicular to the shaft 4, discharge of refrigerant gas from the bores $1_{-1}$ to the discharge chamber $3_{-2}$ continues. The refrigerant gas in the suction chamber $3_{-1}$ is drawn into the bores $1_{-1}$ and discharged into the discharge chamber $3_{-2}$. Accordingly, when the swash plate 13 is at the minimum inclined position, a circulation passage is formed in the compressor between the discharge chamber $3_{-2}$, the pressurizing passage 33, the crank chamber $3_{-1}$, the conduit 32, the pressure releasing hole $18_{-1}$, the suction chamber $3_{-2}$, and the cylinder bores $1_{-1}$. The lubricating oil mixed with the refrigerant gas flows together with the gas in the circulation passage and lubricates the inside of the compressor.

In this state, a pressure difference exists between the discharge and crank chambers $3_{-1}$, $2_{-1}$ and the suction chamber 3. Since the cross-sectional area of the pressure releasing hole $18_{-1}$ is not large enough to eliminate the pressure difference, the swash plate 13 is maintained at its minimum inclined position by the pressure difference.

When the solenoid 35 is activated, the pressurizing hole 33 is closed. The pressure difference existing between the crank chamber $2_{-1}$ and the suction chamber $3_{-1}$ causes the gas in the crank chamber $2_{-1}$ to be conveyed to the suction chamber $3_{-1}$ through the conduit 32 and the pressure releasing hole $18_{-1}$. This lowers the pressure in the crank chamber $2_{-1}$ and increases the tilt of the swash plate 13 further from perpendicular.

In a clutchless compressor that operates in the above manner, refrigerant gas discharged into the discharge chamber $3_{-2}$ from the compression chamber defined in each bore $1_{-1}$ is supplied to the muffler chamber 10 through the discharge passage 12. After the gas is temporarily stored in the muffler chamber 10, the gas is returned to the external refrigerant circuit 14. The muffler chamber 10 reduces the pressure fluctuation of the gas. The refrigerant gas is helically routed about the separator 11 in the direction indicated by an arrow P shown in FIGS. 1 and 3. The gas moves toward the inlet $11_{-1}$ and enters the separator 11 from the inlet $11_{-1}$. The gas then flows into the refrigerant circuit 14 from the outlet $11_{-2}$. When the refrigerant gas travels about the separator 11, mist-like lubricating oil is separated from the gas by centrifugal force. Accordingly, this efficiently prevents oil from being discharged externally together with the gas. The separated oil moves along the bottom of the circulation chamber $10_{-1}$ and flows into the reserve compartment $10_{-2}$ after passing through the oil passages $1_{-4}$, $2_{-6}$.

The lubricating oil in the reserve compartment $10_{-2}$ flows into the crank chamber $2_{-1}$ through the restricted passage $2_{-5}$ (shown in FIGS. 1 and 4), which restricts the flow of oil from the compartment $10_{-2}$ to the crank chamber $2_{-1}$. This oil lubricates the various components inside the crank chamber $2_{-1}$. In addition, since the reserve compartment $10_{-2}$ is included in the area acted upon by discharge pressure, the pressure also acts on the surface of the lubricating oil therein. However, the oil in the passage $2_{-5}$ forms a film and thus closes the passage $2_{-5}$. Therefore, refrigerant gas with the discharge pressure applied thereto is substantially prevented from flowing into the crank chamber $2_{-1}$ through the passage $2_{-5}$.

Preventing the deterioration of the lubricating oil, recovered in the above manner, is necessary for satisfactory lubrication. The heat produced in the compressor is one of the elements which cause deterioration of the lubricating oil. Heat of the compressor also starts the deterioration of the lip seal 47 at an early stage. In a clutchless compressor, such as the compressor of this embodiment, as long as the engine is operating, the swash plate 13 keeps rotating. Therefore, even if the compressor does not perform substantial discharging, that is, even if the swash plate 13 is at the minimum inclined position, the moving parts produce heat. Accordingly, a clutchless compressor generates more heat than a compressor that is clutched.

However, the clutchless compressor does not require a solenoid for an electromagnetic clutch between the pulley 5 and the front housing 2. This allows the fins 46 to extend to the front end of the front housing 2 and also allows the fan $5_{-1}$ to be arranged inside the pulley 5.

Therefore, when the compressor is operated, the fan sends air toward the front end of the fins 46. The air then flows rearward guided by the fins 46 along the periphery of the front housing 2. Accordingly, the entire outer periphery of the clutchless compressor is cooled. This reduces deterioration of the lubricating oil and the lip seal 47.

In this embodiment, the fan $5_{-1}$ is formed integrally with the pulley $5_{-1}$. This reduces the length of the compressor. In addition, helical routing of the heated refrigerant gas in the muffler chamber 10 separates the lubricating oil and then reserves it. Thus, the oil in the muffler chamber 10 tends to be heated to a high temperature. To cope with this, some of the fins 46 are connected to the wall $2_{-3}$ to extend in the direction of air flow. This increases heat transfer from the walls $2_{-3}$, $1_{-2}$, which define the muffler chamber 10, and prevents the chamber 10 from being excessively heated.

In this embodiment, the boss $2_{-2}$ is press fitted into the inner race of the angular contact bearing 6 as the bearing is drive fitted onto the outer periphery of the boss $2_{-2}$. If the front end of the front housing 2 is deformed when press fitting the boss $2_{-2}$, it is possible that a reaction force will alter the position of the drive plate 8. This will alter the top dead center position of the pistons 25. This leads to a pressure imbalance in the compressor when the inclination of the swash plate 13 is minimum and may prevent the swash plate 13 from smoothly returning to the maximum inclined position from the minimum inclined position.

However, in this embodiment, the fins 46, extending from the front end of the front housing 2 toward a rearward direction, reinforce the front end of the housing 2. This prevents deformation of the front housing 2 during installation of the angular contact bearing 6.

Figure 6:
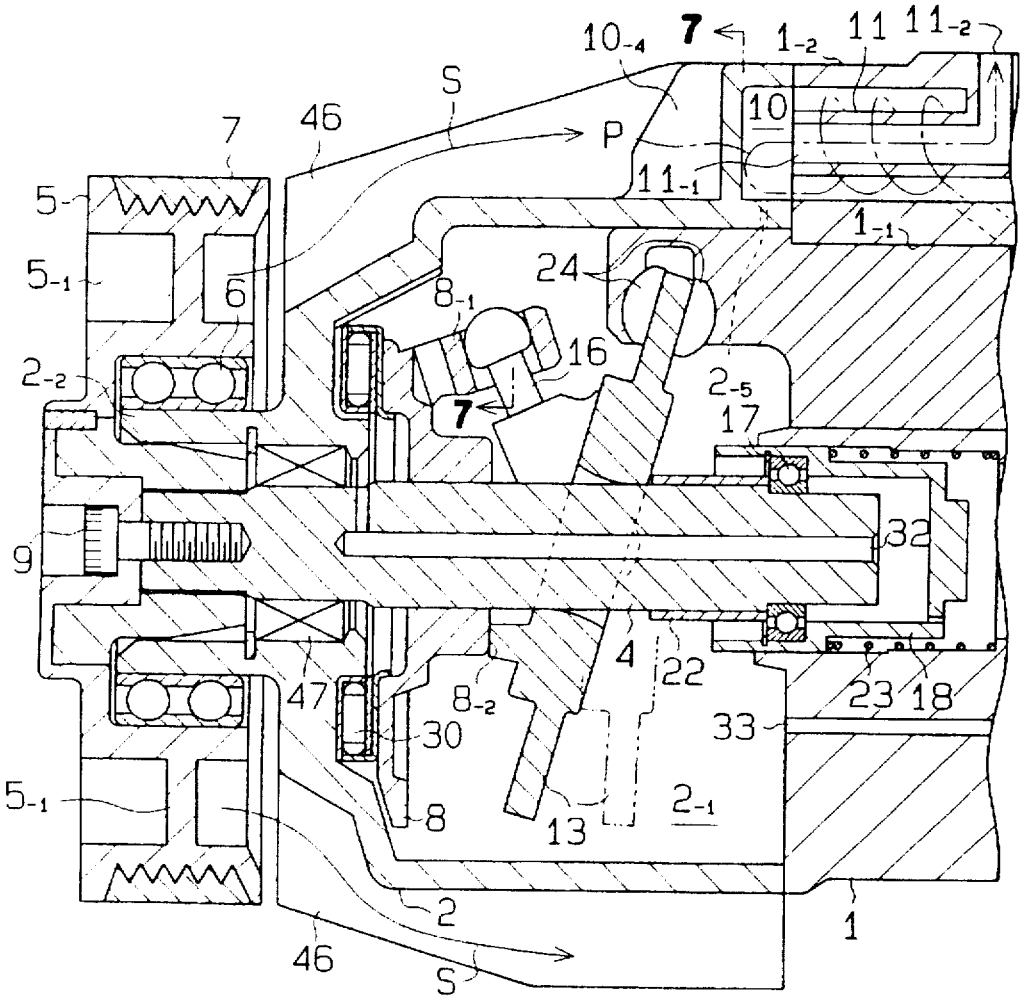
FIG. 6 is a fragmentary cross-sectional view showing the main portion of a modified compressor.
Figure 7:
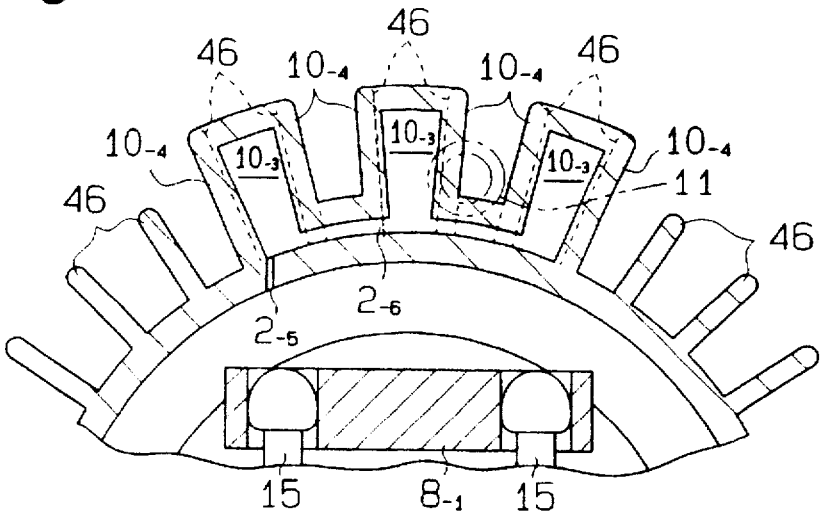
FIG. 7 is a fragmentary cross-sectional view along line 7—7 of FIG. 6.

A modification of the first embodiment will now be described with reference to FIGS. 6 and 7. Corresponding parts are denoted with the same numerals. In this modification, a portion of the muffler chamber 10 on the front housing 2 side is divided into cells $10_{-3}$ (three are defined in this example). Walls $10_{-4}$ of the cells $10_{-3}$ are formed integrally with some of the fins 46. Thus, the walls $10_{-4}$ form a part of the fins 46. This structure further improves the heat transfer performance of the muffler chamber 10.

Another modification of the first embodiment will now be described with reference to FIGS. 8 and 9. Corresponding parts are denoted with the same numerals. In this modification, a muffler chamber 43 is defined by a cylindrical wall $1_{-5}$, which is formed integrally with the cylinder block 1 and projects in the radial direction from the peripheral surface of the block 1. A cylindrical oil separator 44 is formed in the muffler chamber 43 along the axis of the chamber 43. The bottom end of the oil separator 44 is separated from the bottom surface of the muffler chamber 43. Thus, an inlet $44_{-1}$ located at the lower side of the separator 44 is opposed to the bottom surface of the muffler chamber 43. An outlet $44_{-2}$ located at the upper side of the separator 44 is connected to the external refrigerant circuit 14. The muffler chamber 43 is communicated with the crank chamber $2_{-1}$ through a restricted passage 45. The outlet $12_{-1}$ of the discharge passage 12, which communicates the muffler chamber 43 with the discharge chamber $3_{-2}$, is directed toward the upper wall of the separator 44 and the inner side of the wall $1_{-5}$.

A plurality of second fins 48 are formed in the outer side of the wall $1_{-5}$ extending in the radial direction of the muffler chamber 43.

Figure 8:
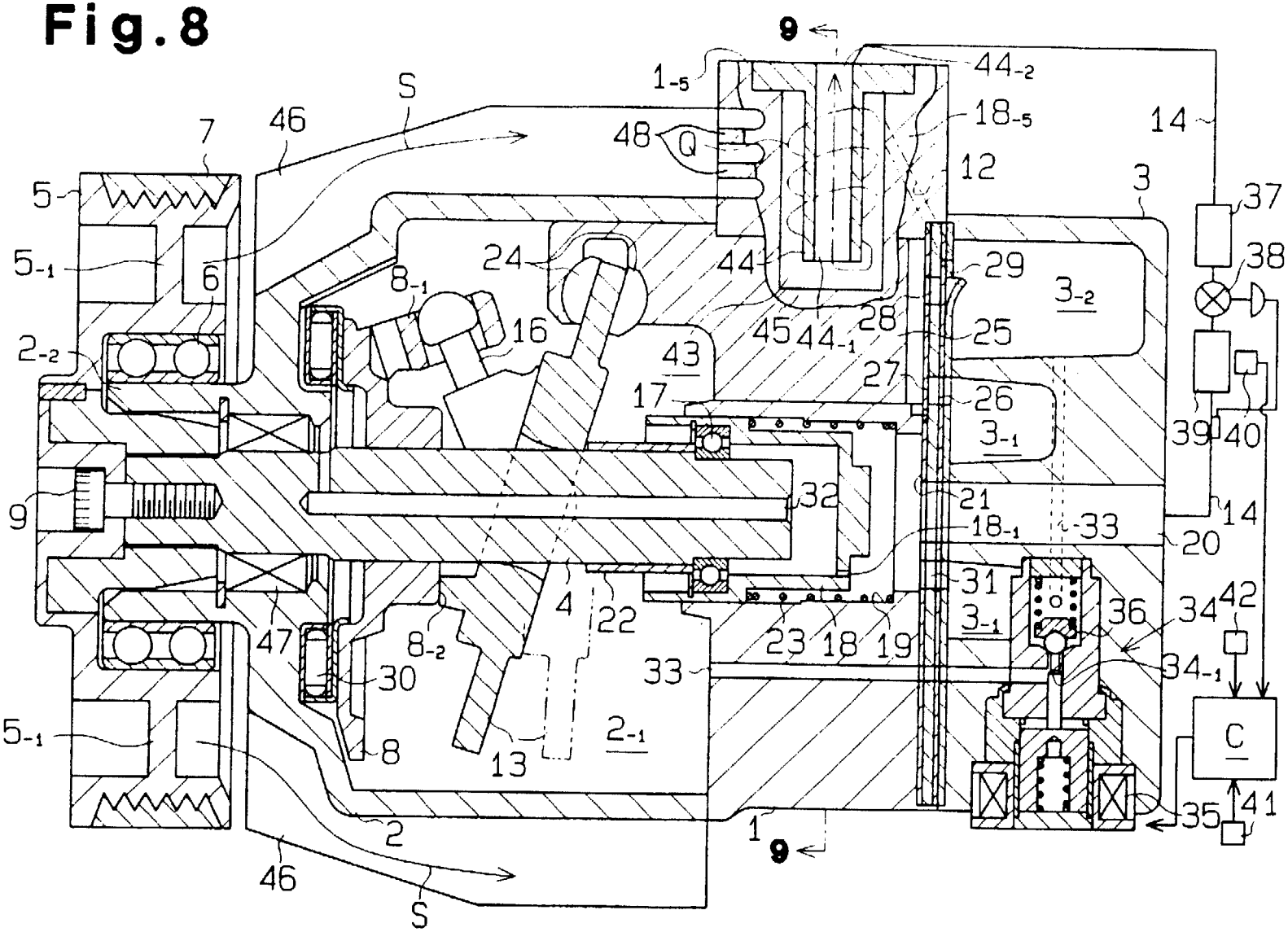
FIG. 8 is a side cross-sectional view showing a modified compressor.
Figure 9:
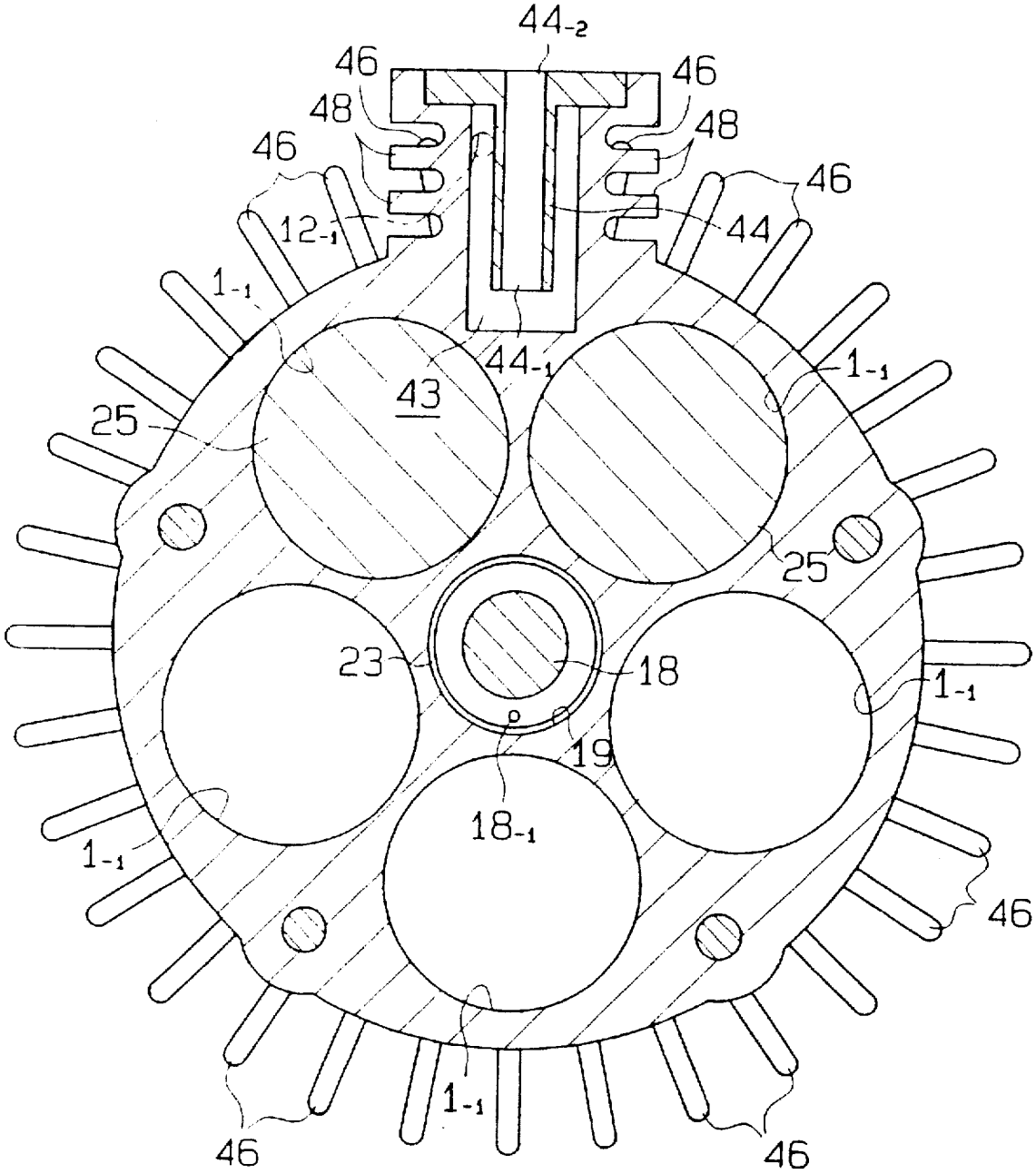
FIG. 9 is a cross-sectional view along line 9—9 of FIG. 8.

The refrigerant gas conveyed to the muffler chamber 43 from the discharge chamber $3_{-2}$ through the discharge passage 12 is helically routed about the separator 44 and is directed downward to the inlet $44_{-1}$, as shown by arrow Q in FIG. 8. The gas then passes through the interior of the separator 44 to be discharged to the external refrigerant circuit 14. The lubricating oil included in the refrigerant gas routed about the separator 44 is separated from the gas by centrifugal force. The separated oil falls to the bottom of the muffler chamber 43 and flows into the crank chamber $2_{-1}$ through the restricted passage 45.

Efficiency in recovery of lubricating oil is similar to that of the first embodiment. The air sent from the fan $5_{-1}$, is guided along the fins 46 and the second fins 48 and cools the muffler chamber 43 efficiently. In addition, the fan may be provided separately from the pulley.

A fourth embodiment of the present invention will now be described with reference to FIGS. 10 through 12. Structure differing from the first embodiment will mainly be described. Corresponding parts will be denoted with the same numerals.

Figure 10:
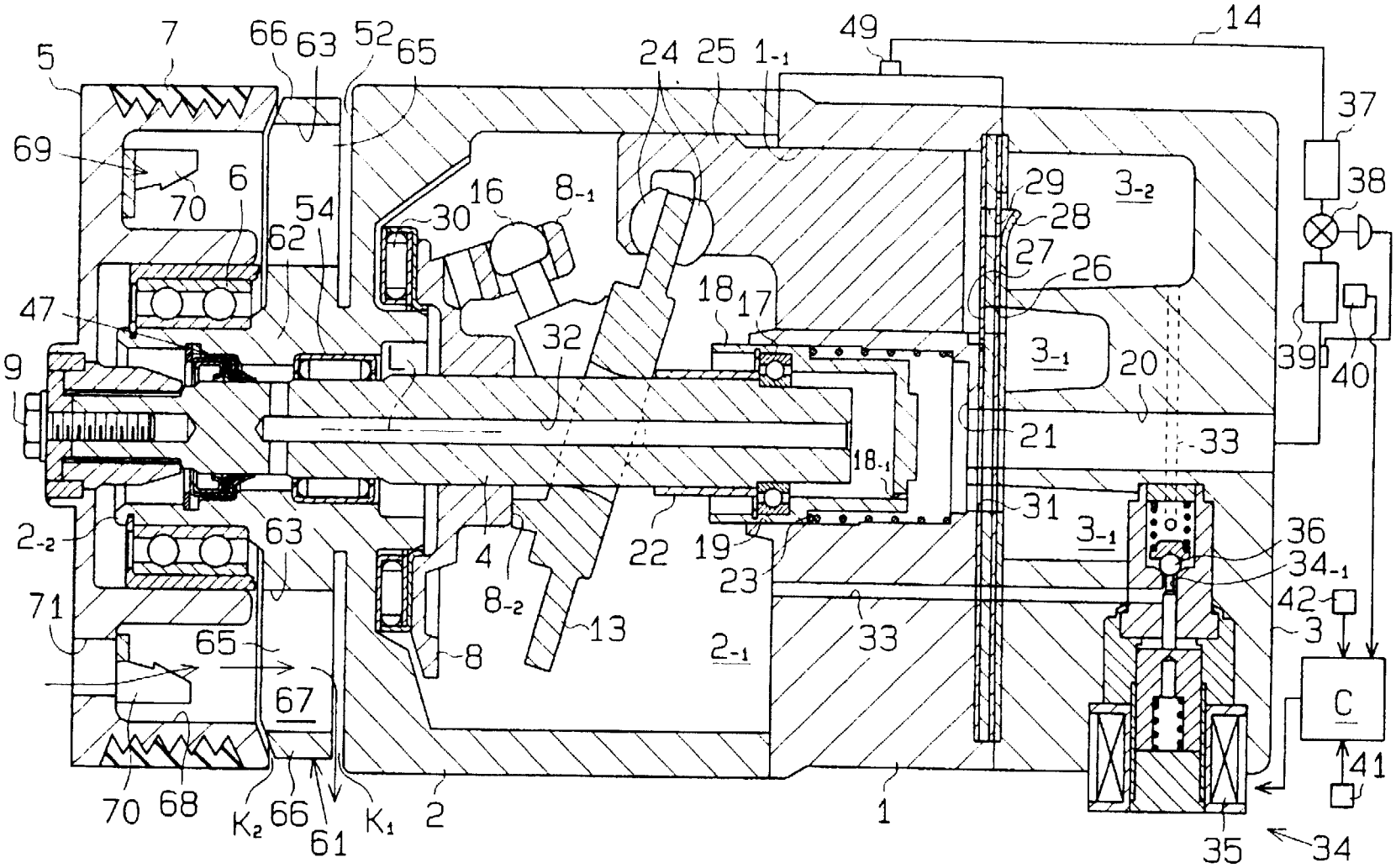
FIG. 10 is a side cross-sectional view showing a compressor according to the fourth embodiment of the present invention.
Figure 11:
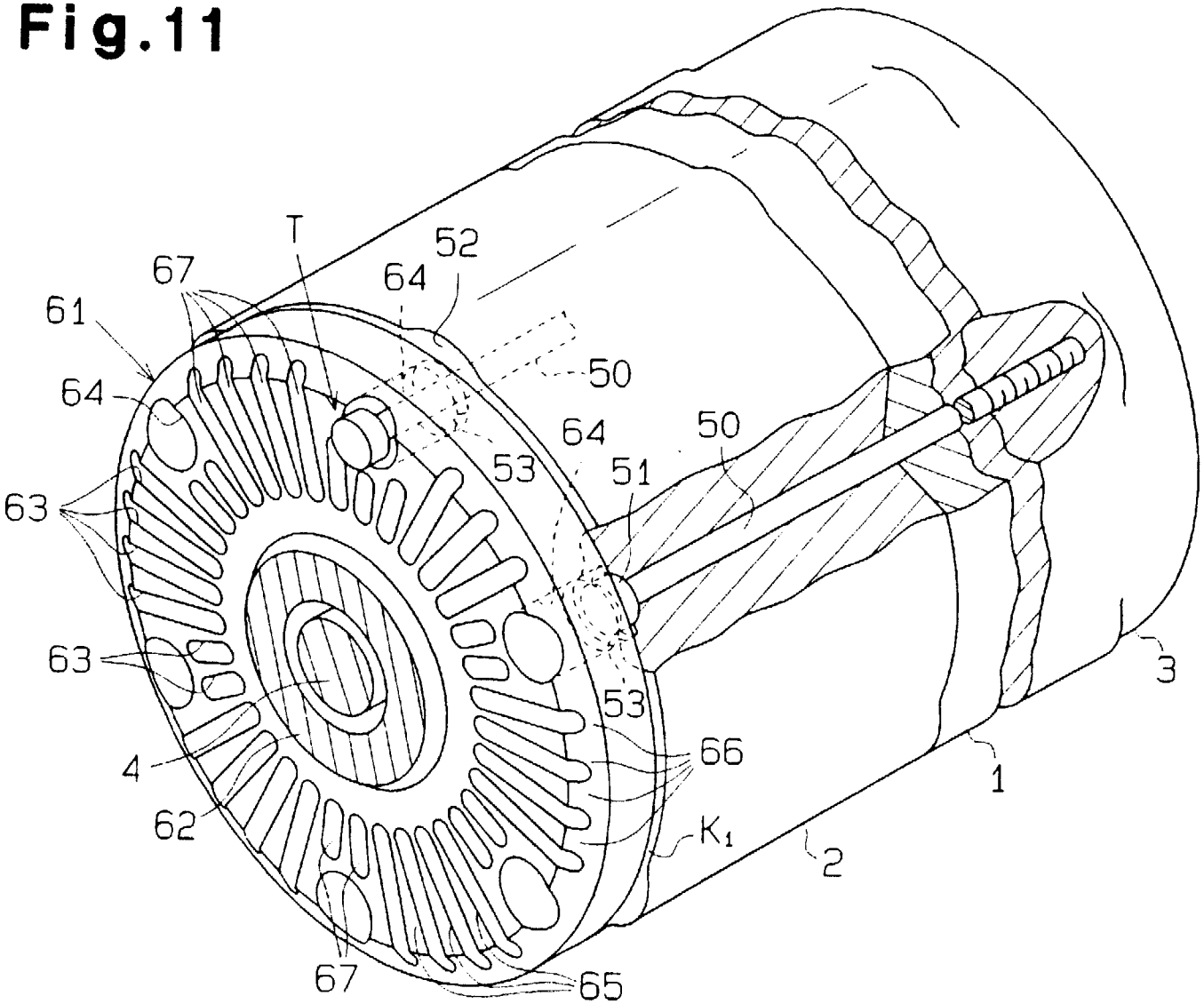
FIG. 11 is a perspective view showing the compressor of FIG. 10 with a broken view of a portion.
Figure 12:
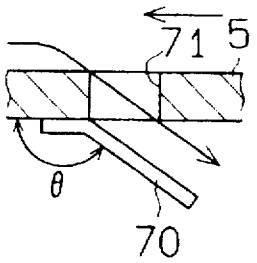
FIG. 12 is a partial cross-sectional view showing the fin illustrated in FIG. 10.

In the fourth embodiment, the front housing 2, cylinder block 1, and rear housing 3 are fastened together by a plurality of bolts 50 (six are employed in this embodiment), as shown in FIG. 11. A plurality of recesses 53 are formed in a front wall 52 of the front housing 2 to accommodate a head 51 of each bolt 50. This prevents the heads 51 from protruding from the surface of the front wall 52. The front and rear housings 2, 3, and the cylinder block 1 are made of an aluminum or aluminum alloy material. As shown in FIG. 10, a radial bearing 54 is arranged at the inner side of a boss 62 and supports the front side of the rotary shaft 4. The bearing 54 is located between the lip seal 47 and the thrust bearing 30. The external refrigerant circuit 14 is connected to the discharge chamber $3_{-2}$ by a discharge outlet 49.

As shown in FIGS. 10 and 11, a flange 61, extending from the outer periphery of the boss 62, is formed integrally with the boss 62. A predetermined gap K1 is defined between the rear surface of the flange 61 and the wall 52. A predetermined gap K2 is also defined between the front surface of the flange 61 and the pulley 5. Gap K1 is greater than K2 (K1>K2).

A plurality of radially extending apertures 63 extend through the flange 61 in the axial direction. A plurality of holes 64 (six are shown) are formed in the radially outer region of the flange 61 with the holes 64 corresponding to the recesses 53. The fastening and unfastening of the bolts 50 is carried out through the holes 64 as shown in FIG. 11 by the arrow T.

Fins 65 are defined between each aperture 63 on the flange 61. The fins 65 extend in the radial direction with respect to the axis L. Connecting sections 66 are defined between the periphery of the flange 61 and the outer ends of adjacent fins 65. The space encompassed by the fins 65 and the connecting sections 66, that is, the apertures 63, constitute a venting passage 67.

A fan section 68 is provided in the pulley 5. The fan section 68, defined at the rear side of the cup shaped pulley 5, extends along the circumferential direction of the pulley 5. Venting blades 70, which constitute a fan 69, are provided in the fan section 68. The blades 70 are arranged with a predetermined space between one another along the circumferential direction. As shown in FIG. 12, each blade 70 is inclined at an obtuse angle θ with respect to the inner bottom surface of the wall of the fan section 68. A plurality of air intake holes 71 (only one shown in FIG. 10) are formed extending through the wall of the fan section 68 in the pulley 5. Each intake hole 71 corresponds to one of the blades 70. Therefore, as shown in FIG. 12, air is drawn into the fan section 68 through the intake holes 71 by the blades 70 when the pulley 5 is rotated in a direction indicated by the arrow. The drawn in air is then sent toward the venting passage 67 in the flange 61.

The operation of the embodiment of FIG. 10 will now be described. In the state shown in FIG. 10, the solenoid 35 is activated and thus the pressurizing passage 33 is closed. Therefore, the highly pressurized refrigerant gas in the discharge chamber $3_{-2}$ is not conveyed to the crank chamber $2_{-1}$. In this state, the conduit 32 and the pressure releasing hole $18_{-1}$ release the pressure in the crank chamber $2_{-1}$ to a value close to the pressure in the suction chamber $3_{-1}$, that is, the suction pressure. This causes the swash plate 13 to be maintained at the maximum inclined position and results in maximum displacement.

While discharge is performed with the swash plate 13 retained at the maximum inclined position, a decrease in cooling load (requirement) lowers the temperature of the evaporator 39. When the temperature of the evaporator 39 becomes lower than a predetermined value, the solenoid 35 is deactivated and the pressurizing passage 33 is opened. This conveys the highly pressurized refrigerant gas in the discharge chamber $3_{-2}$ to the crank chamber $2_{-1}$ through the pressurizing passage 33 and raises the pressure in the chamber $2_{-1}$. The pressure increase in the crank chamber $2_{-1}$ immediately reduces the inclination of the swash plate 13. That is, the swash plate 13 moves toward a perpendicular position.

The reduction in the inclination of the swash plate 13 results in the spool 18 disconnecting the suction passage 20 from the suction chamber $3_{-1}$. In this state, an internal circulating passage, constituted by the discharge chamber $3_{-2}$, the pressurizing passage 33, the crank chamber $2_{-1}$, the conduit 32, the pressure releasing hole $18_{-1}$, the suction chamber $3_{-2}$, and the cylinder bores $1_{-1}$, is formed in the compressor. Since the minimum inclined position of the swash plate 13 is not quite perpendicular, rotation of the rotary shaft 4 causes discharge of refrigerant gas into the discharge chamber $3_{-2}$ from the cylinder bores $1_{-1}$ even if cooling is not required. Accordingly, the discharged gas circulates in the circulating passage. The lubricating oil included in the gas lubricates the interior of the compressor.

Friction between the lip seal 47 and the shaft 4 produces heat in the seal 47. However, this heat is transferred through the boss 62 and to the fins 65 provided in the flange 61.

In addition, rotation of the pulley 5 causes the fan 69 to draw air into the fan section 68 through the intake holes 71 and toward the fins 65. This enhances the heat transfer effect of the fins 65. As a result, deterioration of the seal 47, which is caused by heat, is reduced and the sealing function is maintained.

The structure of this embodiment also enables the following effects. The gap K1, defined between the fins 65 and the front wall 52 of the front housing 2, ensures that heat transferred from the crank chamber $2_{-1}$ to the wall 52 is transferred to the ambient air without being conducted to the fins 65. Heat is transferred to the fins 65 from the crank chamber $2_{-1}$ via the boss 62. Therefore, the seal 47 is not excessively heated.

The venting passage 67 is defined by connecting the outer ends of the fins 65. Thus, the air sent toward the fins 65 flows through the passage 67 and is then discharged externally from the gap K1. The connecting sections 66 prevent the drawn in air from escaping in the radial direction. They also prevent external air currents from effecting the flow of the air between the fins 65. This enables the entire surface of the fins 65 to be cooled by the air and enhances the heat transfer effect of the fins 65. In addition, when the air is conveyed outward through the gap K1, the air contacts the front wall 52 of the front housing 1 and cools it.

The fins 65 are formed integrally with the boss 62. Thus heat conducts effectively from the boss 62 to the fins 65. The drawn in air tends to flow outward through the gap K1, since gap K1 is greater than the gap K2. This suppresses the escape of air through the gap K2 before it reaches the venting passage 67 and enables air to be introduced into the passage 67 efficiently.

Since holes 64 through which the bolts 50 pass through are defined in the flange 61, integral formation of the flange 62 with the boss 62 does not interfere with the assembling of the front housing 1, the cylinder block 2, and the rear housing 3. Thus, it is possible to enlarge the outer diameter of the flange 61 to a size larger than shown in FIG. 10. In this case, it is possible to provide sufficient surface area on the fins 65 to transfer a desired amount of heat even if the flange 61 is thin and the axial length of the compressor is shortened.

Furthermore, since air may pass through the holes 64, the holes 64 have the same function as the air venting passages 67 (apertures 63). Thus, although the provision of the holes 64 shortens the length of those apertures 63 radially inward of the holes 64, the amount of air flowing through is not reduced.

The head 51 of each bolt 50 is accommodated in the recess 53 and does not protrude from the surface of the front wall 52. Hence, the heads 51 do not interfere with the flow of ambient air.

In addition to the lip seal 47, heat is produced in the radial bearing 54. However, since the fins 65 are located near the bearing 54, the heat of the bearing 54 is transferred to the fins 65 after being conducted through the boss 62.

Figure 13:
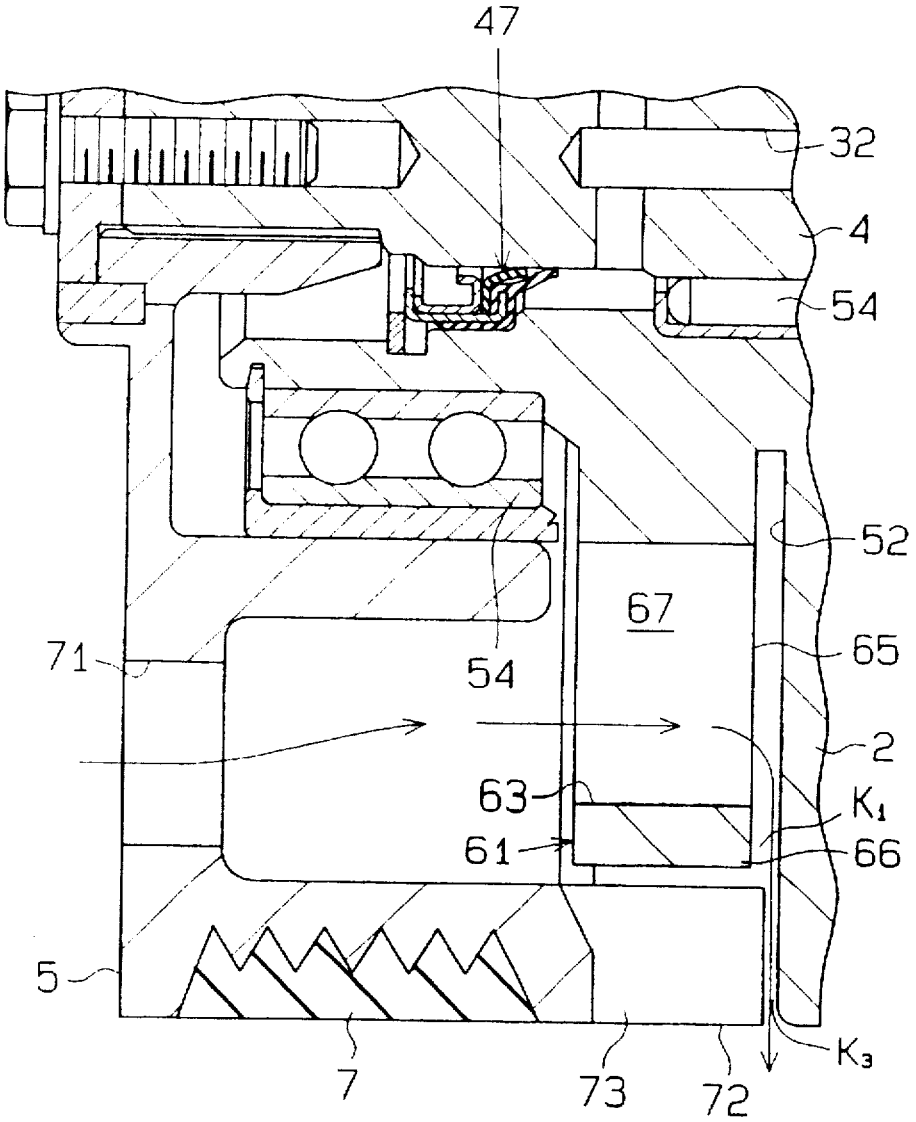
FIG. 13 is a partial and enlarged view of a modified compressor.

A modification of the embodiment illustrated in FIG. 10 is shown in FIG. 13. In this modification, the location of the fan 72 differs from that shown in FIG. 10. More specifically, the outer diameter of the flange 61 is smaller than the outer diameter of the pulley 5. Hence, an annular space is defined between the periphery of the flange 61, the periphery of the pulley 5, and the front wall 52 of the front housing 1. A plurality of blades 73 (only one shown) which constitute the fan 72 project from the rear side of the pulley 5 toward the front wall 52 in the annular space with a predetermined interval defined between one another. A gap K3 is defined between the fan 72 and the wall 52. The gap K3 is smaller than the gap K1.

Integral rotation of the pulley 5 and the fan 72 causes a pressure difference between the inner and outer sides of the fan 72. This results in ambient air being drawn into the venting passages 67 through the intake holes 71 and then sent outward through the gaps K1, K3. This current enhances heat transfer from the fins 65 and the front wall 52.

The rotating diameter of the fan 72 in this modification is larger than the fan $5_{-1}$ shown in FIG. 1. Thus, the amount of ambient air drawn in is increased.

The present invention may also be modified in the manners described below.

(1) The connecting sections 66 connecting the outer ends of the fins 65 may be omitted.

(2) The flange 61 and the boss 62 may be constituted by separate bodies. In this case, the flange 61 is fixed to the boss 62 by press fitting, or the like. This simplifies the shape of the front housing 1 and facilitates machining.

(3) The heads 51 of the bolts 50 may be arranged at the rear housing 3 side. This omits the necessity for the holes 64 in the flange 61.

(4) The air intake holes 71 may be inclined with respect to the rotary axis of the pulley 5. This facilitates the intake of air.

(5) The present invention may be employed in a compressor with an electromagnetic clutch provided between the pulley and the rotary shaft 4.

Although several embodiments of the present invention have been described herein, it should be apparent to those skilled in the art that the present invention may be embodied in many other specific forms without departing from the spirit or scope of the invention. Therefore, the present examples and embodiments are to be considered as illustrative and not restrictive and the invention is not to be limited to the details given herein, but may be modified within the scope of the appended claims.

What is claimed is:

1. A compressor having a compression mechanism within a housing for compressing a refrigerant gas responsive to the rotation of a rotary shaft operatively connected to an external power source, said compressor comprising:

a rotary member mounted on the rotary shaft and located on one side outside of said housing for transmitting power from said external power source to said rotary shaft;

a fan for sending air to the outer surface of said housing by rotating with said rotary member;

a plurality of heat transferring fins disposed in spaced apart relation circumferentially about the outer periphery of the housing and extending along said housing in the axial direction of said housing from a point adjacent to said fan for guiding air from the fan along said housing;

a chamber for containing said refrigerant gas compressed within said housing, said chamber having an outer wall along which said air from said fan is directed by said fins; and a separator disposed within said chamber for separating a lubricant oil mixed with said refrigerant gas from said refrigerant gas.

2. The compressor according to claim 1, wherein said rotary member includes a pulley, said fan being formed integrally with said pulley.

3. The compressor according to claim 1, wherein said chamber has an inlet and an outlet, wherein said separator has a cylindrical shape and communicates with said inlet and outlet, and wherein said refrigerant gas passes from said inlet to said chamber, is routed circularly around said separator, passes through said separator, and then is routed out through said outlet.

4. A compressor having a housing and a rotary shaft for receiving driving power from an external power source, wherein a refrigerant gas is compressed by a compression mechanism located within the housing and operated responsive to the rotation of said rotary shaft, said compressor comprising:

a pulley located at one side outside of said housing;

a fan for sending air to the outer periphery of said housing by rotating with said pulley;

a plurality of heat transferring fins disposed in spaced apart relation circumferentially about the outer periphery of said housing and extending along the outer surface of said housing in the axial direction of said housing from a point adjacent to said fan for guiding air from the fan along said housing;

a chamber for containing said refrigerant gas compressed within said housing, said chamber having an outer wall along which said air from said fan is guided by said fins; and a separator disposed within said chamber for separating a lubricant oil mixed with said refrigerant gas from said refrigerant gas.

5. The compressor according to claim 4, wherein said chamber has an inlet and an outlet, wherein said separator has a cylindrical shape and communicates with said inlet and outlet, and wherein said refrigerant gas passes from said inlet to said chamber, is routed circularly around said separator, passes through said separator, and then is routed out through said outlet.

6. A compressor having a compression mechanism within a housing for compressing a refrigerant gas according to the rotation of a rotary shaft operatively connected to an external power source, said compressor comprising:

a boss section protruding from a wall surface of said housing and supporting a part of said rotary shaft; and at least one heat transferring fin provided at the outer periphery of said boss section, wherein the distance between said fin and said wall surface of said housing define a first gap.

7. The compressor according to claim 6 further comprising a seal located between said boss section and said rotary shaft for sealing the inside of said housing.

8. The compressor according to claim 6 further comprising:

a rotary member mounted on said rotary shaft for transmitting power from said power source to said rotary shaft, said rotary member being separated from said fin by a second gap; and a fan for sending air to each said fin by rotating with said rotary shaft.

9. The compressor according to claim 8, wherein said first gap is greater than said second gap.

10. The compressor according to claim 6, wherein said at least one heat transferring fin is one of a plurality of heat transferring fins that protrude radially from said boss section and have tip portions connected with each other.

11. The compressor according to claim 10, wherein said heat transferring fins are located radially inward from said rotary member.

12. The compressor according to claim 8, wherein said rotary member has a pulley formed in a cup-shape and a wall section fixed to said rotary shaft, said wall section having a plurality of holes for introducing air into the inside of said pulley and a plurality of air moving blades provided in association with the holes, said blades constituting said fan.

13. A compressor having a rotary shaft for receiving driving power from an external power source with a pulley, wherein a refrigerant gas is compressed by a compression mechanism located within a housing and operated according to the rotation of said rotary shaft, said compressor comprising:

a boss section protruding from a wall surface of said housing and supporting a part of said rotary shaft;

at least one heat transferring fin provided at the outer periphery of said boss section, wherein the distance between each said fin and said wall surface of said housing define a first gap;

said pulley being located around said boss section and being connected to said rotary shaft; and a fan for sending air to each said fin by rotating with said pulley.

14. A compressor having a compression mechanism within a housing for compressing a refrigerant gas responsive to the rotation of a rotary shaft operatively connected to an external power source, said compressor comprising:

an external boss located on one side of said housing with part of the rotary shaft supported therein;

a seal located between the boss and the rotary shaft for sealing off the housing;

a rotary member mounted on the rotary shaft and journalled on said boss for transmitting power from said external power source to said rotary shaft;

a fan for sending air to the outer surface of said housing by rotating with said rotary member;

a plurality of heat transferring fins disposed in spaced apart relation circumferentially about the outer periphery of the housing and extending along said housing in the axial direction of said housing from a point adjacent to said fan for guiding air from the fan along said housing;

a chamber for containing said refrigerant gas compressed within said housing, said chamber having an outer wall along which said air from said fan is directed by said fins; and a separator disposed within said chamber for separating a lubricant oil mixed with said refrigerant gas from said refrigerant gas.

* * * * *